United States Patent [19]

Ueda et al.

[11] Patent Number: 4,583,989

[45] Date of Patent: Apr. 22, 1986

[54] METHOD FOR IMPROVING COLOR FASTNESS: MONO- AND DI-ALLYLAMINE COPOLYMER FOR REACTIVE DYES ON CELLULOSE

[75] Inventors: Toshio Ueda; Kenzi Kageno, both of Koriyama; Susumu Harada, Tokyo, all of Japan

[73] Assignee: Nitto Boseki Co., Ltd., Fukushima, Fed. Rep. of Germany

[21] Appl. No.: 670,481

[22] Filed: Nov. 13, 1984

[30] Foreign Application Priority Data

Nov. 15, 1983 [JP] Japan ..... 58-214776

[51] Int. Cl.[4] ..... D06P 5/08

[52] U.S. Cl. ..... 8/543; 8/554; 8/602; 8/918

[58] Field of Search ..... 8/543, 554, 602

[56] References Cited

U.S. PATENT DOCUMENTS

| | | | |
|---|---|---|---|
| 3,490,859 | 1/1970 | Soiron et al. | 8/556 |
| 4,417,898 | 11/1983 | Hasler et al. | 8/543 |
| 4,439,203 | 3/1984 | Runyon et al. | 8/496 |
| 4,475,918 | 10/1984 | Kissling et al. | 8/495 |
| 4,511,707 | 4/1985 | Runyon et al. | 8/496 |

FOREIGN PATENT DOCUMENTS 2093076 8/1982 United Kingdom .

*Primary Examiner*—A. Lionel Clingman
*Attorney, Agent, or Firm*—Bert J. Lewen; Henry Sternberg

[57] ABSTRACT

The present invention relates to a method for improving the color fastness of a dyed product which comprises treating a dyed product dyed with a reactive dye with the aqueous solution of a copolymer of monoallylamine and a specified diallylamine derivative.

7 Claims, No Drawings

METHOD FOR IMPROVING COLOR FASTNESS: MONO- AND DI-ALLYLAMINE COPOLYMER FOR REACTIVE DYES ON CELLULOSE

DETAILED DESCRIPTION OF THE INVENTION

The present invention relates to a method for improving the color fastness of a product dyed with a reactive dye.

For dyeing cellulosic fibers, reactive dye is more frequently used than direct dye in the recent time, because a dyed product given by reactive dye has a clear color and an excellent wet color fastness.

Regarding the color fastness of dyed product given by reactive dye, however, there is the problem of resistance to acid hydrolysis (the decreasing of washing fastness during the storage). Although a reactive dye forms a covalent bond with the fiber and thereby is tightly bonded with the latter, the bond may be broken with time after the dyeing by the influence of acidic substance or the like, which results in falling-off of dye and stain on other clothes. As a countermeasure for this problem, the dyed product is treated with a dilute aqueous solution of a cationic polymer called "dye fixative". If the dye fixing treatment is carried out with a condensate of dicyandiamide and a polyethylenepolyamine such as ethylenediamine, diethylenetriamine and the like, the resistance of dyed product to acid hydrolysis becomes sufficiently satisfactory. However, hue of the dyed product changes and its fastness to light and chlorine decreases upon the treatment with this type of dye fixative. If a condensate of an amine and epichlorohydrin or a quaternary ammonium salt type polycation is used as the dye fixative, no color change occurs and fastness to light does not decrease upon the treatment. However, the dyed product treated with these fixatives is insufficient in the resistance to acid hydrolysis.

In view of the above-mentioned present condition, the inventors have conducted elaborated studies with the aim of developing a method for fixing a dye by which a sufficient resistance to acid hydrolysis can be exhibited without the disadvantages mentioned above. As the result, it has been discovered that the above-mentioned object can be achieved by a copolymer of monoallylamine and a diallylamine derivative represented by the following formula (I) or (II) or by a salt of said copolymer:

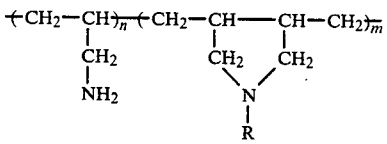

(I)

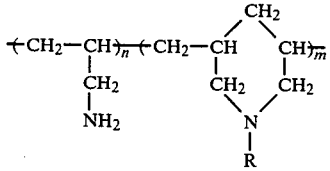

(II)

wherein R represents a group selected from the groups consisting of H, an alkyl group having 1 to 18 carbon atoms, a benzyl group, a group

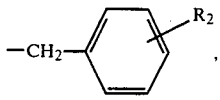

wherein $R_2$ is an alkyl group having 1 to 18 carbon atoms, and a group $—CH_2CH_2OH$; and n and m independently represent a positive integer, provided that the ratio n/m is in the range from 95/5 to 5/95. Based on this discovery, the present invention has been accomplished. Thus, the present invention relates to a method for improving color fastness of a dyed product dyed with a reactive dye which comprises treating said dyed product with the aqueous solution of the above-mentioned polymer. A dyed product treated with the polyamine of the present invention has an excellent resistance to acid hydrolysis enough to achieve the object of a dye fixing treatment. Further, when the fixing treatment is carried out with the polyamine of the invention, color change, decrease in light fastness and decrease in chlorine fastness hardly takes place to noticeable extent, so that the polyamine of the invention can be said to be greatly improved in performances as compared with the conventional polyamines used in this treatment.

Further, the polyamine of the invention exhibits excellent performances with regard to fastness to water, fastness to washing and fastness to perspiration, too.

The polyamine or the copolymer used in the invention is produced by copolymerizing a salt of monoallylamine with a salt of a diallylamine derivative having the following formula:

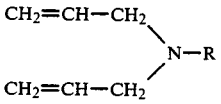

wherein R represents a group selected from the groups consisting of H, an alkyl group having 1 to 18 carbon atoms, a benzyl group, a group

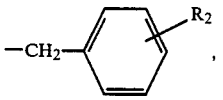

wherein $R_2$ is an alkyl group having 1 to 18 carbon atoms, and a group $—CH_2CH_2OH$. Typical examples of said diallylamine derivative include diallylamine, methyldiallylamine, ethyldiallylamine, propyldiallylamine, butyldiallylamine, amyldiallylamine, octyldiallylamine, lauryldiallylamine, benzyldiallylamine, hydroxyethyldiallylamine and the like.

The copolymer can be produced by copolymerizing mineral acid salts of the two components in water or a polar solvent in the presence of a polymerization initiator such as ammonium persulfate, benzoyl peroxide, tert-butyl hydroperoxide, azobis-isobutyronitrile, azobis(2-amidinopropane) hydrochloride and the like. All the copolymers produced in the above-mentioned manner are readily soluble in water. It should be noted here that the structural formula of the copolymer of monoallylamine and diallylamine derivative or salt of said copolymer was expressed by a formula involving 6-membered ring (formula (II)) in the past which was amended to a formula involving 5-membered ring (formula (I)) at the filing time of patent application of the present invention, and therefore both the formulas (I) and (II) express an identical copolymer.

The process for treating a dyed product with the copolymer of the invention is not critical, but hitherto known processes may appropriately be adopted for this purpose. For example, a dyed product to be treated is dipped in an aqueous solution containing the copolymer at a concentration of 0.1 to 2 g/liter for a necessary period of time, and then the product is rinsed with water and dried. The liquor ratio is usually 1:10–20, the temperature of treatment is usually in the range from room temperature to 80° C., and the duration of treatment is usually 5 to 20 minutes.

In order to explain the invention more explicitly, the production processes of the copolymers used in the invention are first mentioned below as referential examples, and subsequently some examples illustrating the procedure of the treatment of dyed product with the copolymer of the invention and the results of the treatment are mentioned.

REFERENTIAL EXAMPLES 1–3

A monoallylamine hydrochloride (hereinafter, referred to as "MAA.HCl") solution having a concentration of 59.1% was prepared by adding 1 mole of 35% hydrochloric acid to 1 mole of monoallylamine. The solution was concentrated by means of rotary evaporator under a reduced pressure, until the concentration reached 66.4%. On the other hand, a solution of diallylamine hydrochloride (hereinafter, referred to as "DAA.HCl") having a concentration of 66.4% was prepared by adding 1 mole of 35% hydrochloric acid to 1 mole of diallylamine.

The monomers prepared above were mixed together at a molar ratio shown in Table 1. After heating the monomer mixture to 60° C., 2.5% by weight (based on the monomer mixture) of azobis(2-amidinopropane) hydrochloride was added, and polymerization was carried out for 24 hours. After the reaction, the solution was added into acetone to form a precipitate, and the precipitate was collected by filtration with a glass filter and dried under reduced pressure. Thus, a copolymer of monoallylamine hydrochloride and diallylamine hydrochloride was obtained.

TABLE 1

| Referential Examples | Molar ratio of monomers (MAA.HCl/DAA.HCl) | Monomer concentration (% by wt.) | Polymerization initiator (% by wt.) | Yield (% by wt.) |
|---|---|---|---|---|
| 1 | 0.5/0.5 | 66.7 | 2.5 | 100 |
| 2 | 0.8/0.2 | " | " | " |
| 3 | 0.2/0.8 | " | " | " |

REFERENTIAL EXAMPLE 4

Ten grams of the copolymer of monoallylamine hydrochloride and diallylamine hydrochloride obtained in Referential Example 1 were dissolved into 20 g of water, and 17.6 g of 20% aqueous solution of sodium hydroxide were added thereto. The resulting solution was dialyzed for 24 hours against water by the use of a hollow fiber to remove the sodium chloride formed by neutralization, after which it was freeze-dried to obtain a monoallylaminediallylamine-copolymer.

REFERENTIAL EXAMPLES 5–9

An aqueous solution of methyldiallylamine hydrochloride (hereinafter, referred to as MDA.HCl) was prepared from 1 mole of methyldiallylamine and 1 mole of hydrochloric acid. An aqueous solution of n-propyldiallylamine hydrochloride (hereinafter, referred to as PDA.HCl) was prepared from 1 mole of n-propyldiallylamine and 1 mole of hydrochloric acid. An aqueous solution of n-butyldiallylamine hydrochloride (hereinafter, referred to as BDA.HCl) was prepared from 1 mole of n-butyldiallylamine and 1 mole of hydrochloric acid. An aqueous solution of benzyldiallylamine hydrochloride (hereinafter, referred to as BzDAA.HCl) was prepared from 1 mole of benzyldiallylamine and 1 mole of hydrochloric acid. An aqueous solution of hydroxyethyldiallylamine hydrochloride (hereinafter, referred to as HODA.HCl) was prepared from 1 mole of hydroxyethyldiallylamine and 1 mole of hydrochloric acid. All the solutions were adjusted to a concentration of 66.4% by adding water. On the other hand, a 66.4% aqueous solution of monoallylamine hydrochloride was prepared in the same manner as in Referential Example 1.

The aqueous solution of monoallylamine hydrochloride and the aqueous solution of diallylamine derivative hydrochloride were mixed together at a ratio shown in Table 2, to which azobis(2-amidinopropane) hydrochloride (2.5% based on the monomer mixture) was added at 60° C. The resulting mixture was reacted for 24 hours in the same manner as in Referential Example 1. The results of these experiments (Referential Examples 5–9) are summarized in Table 2.

TABLE 2

| Referential Examples | Molar ratio of monomers | Yield (%) |
|---|---|---|
| 5 | MAA.HCl/MDA.HCl = 0.7/0.3 | 95 |
| 6 | MAA.HCl/PDA.HCl = 0.7/0.3 | 92 |
| 7 | MAA.HCl/BDA.HCl = 0.7/0.3 | 90 |
| 8 | MAA.HCl/BzDA.HCl = 0.7/0.3 | 83 |
| 9 | MAA.HCl/HODA.HCl = 0.7/0.3 | 91 |

REFERENTIAL EXAMPLES 10–14

The copolymers obtained in Referential Examples 5–9 were dehydrochlorinated in the same manner as in Referential Example 4 to obtain monoallylamine-methyldiallylamine copolymer (Referential Example 10), monoallylamine-propyldiallylamine copolymer (Referential Example 11), monoallylamine-butyldiallylamine copolymer (Referential Example 12), monoallylamine-benzyldiallylamine copolymer (Referential Example 13) and monoallylamine-hydroxyethyldiallylamine copolymer (Referential Example 14).

EXAMPLE 1

From each of the copolymers obtained in Referential Examples 1–14, 0.075% aqueous solution was prepared, respectively. Then, a dyed cellulosic fiber cloth which had been dyed with a reactive dye (mentioned below) at a dye concentration of 4% (based on the weight of fiber) by dip dyeing process was immersed in the above-mentioned copolymer solutions at a liquor ratio of 1:20, at a temperature of 50° C., for 20 minutes, and then the cloth was washed with water and air-dried. The dyes used were Levafix Golden Yellow EG, Levafix Brilliant Red E-4B and Levafix Blue E-3R, all manufactured by Bayer A.G.

Then, the resistances to acid hydrolysis of these treated dyed cloths were measured by the following method, and the results were compared with that of untreated dyed cloth. Thus, a test piece was dipped in a 5 g/liter solution of sulfuric acid and squeezed at a squeeze ratio of 80% by means of a squeezing machine. Then, it was dried at 120° C. for 4 minutes. When the test piece had become dry, it was put between two white cloths (one of them was a silk cloth and the other was a cotton cloth) and loosely sewn together to prepare a composite test piece. Subsequently, it was tested according to "Testing Method for Colour Fastness to Water" (JIS-L-0846). The results were as shown in Table 3. In the case of untreated dyed cloth, all the dyes used in this test considerably stained the white cloths. In contrast to it, stain was hardly observed when the treatment was carried out with the copolymer of the invention.

TABLE 3

| | Resistance to acid hydrolysis | | |
|---|---|---|---|
| | Levafix Golden Yellow EG | Levafix Brilliant Red E-4B | Levafix Blue E-3R |
| Untreated | 1 (grade) | 1 (grade) | 1 (grade) |
| Referential Examples | | | |
| 1 | 4 | 4 | 4 |
| 2 | 4 | 4 | 4 |
| 3 | 4 | 4 | 4 |
| 4 | 5 | 5 | 5 |
| 5 | 4 | 4 | 4 |
| 6 | 4 | 4 | 4 |
| 7 | 4 | 4 | 4 |
| 8 | 4 | 4 | 4 |
| 9 | 4 | 4 | 4 |
| 10 | 5 | 5 | 5 |
| 11 | 5 | 5 | 5 |
| 12 | 5 | 5 | 5 |
| 13 | 5 | 5 | 5 |
| 14 | 5 | 5 | 5 |

EXAMPLE 2

From each of the copolymers obtained in Referential Example 1–14, 0.075% aqueous solution was prepared, respectively. A dyed cellulosic fiber cloth which had been dyed by dip dyeing process at a dye concentration of 4% based on the weight of fiber was immersed in the above-mentioned aqueous solutions of copolymer at a liquior ratio of 1:20, at a temperature of 50° C. for 20 minutes, and then it was rinsed with water and dried. The dyes used were Remazol Black B and Remazol Turquoise Blue G manufactured by Hoechst A.G. and Levafix Brilliant Red E-4B manufactured by Bayer A.G.

Then, the treated cloths were subjected to light fastness test in a Fade-Ometer according to the procedure of JIS-L-0842 for 20 hours. The results were as shown in Table 4. No decrease in light fastness was observed at all in the cloths treated with the copolymer of the invention.

TABLE 4

| | Light fastness | | |
|---|---|---|---|
| | Remazol Black B | Remazol Turquoise Blue G | Levafix Brilliant Red E-4B |
| Untreated | 4 | 4 | 4 |
| Referential Examples | | | |
| 1 | 4 | 4 | 4 |
| 2 | 4 | 4 | 4 |
| 3 | 4 | 4 | 4 |
| 4 | 4 | 4 | 4 |
| 5 | 4 | 4 | 4 |
| 6 | 4 | 4 | 4 |
| 7 | 4 | 4 | 4 |
| 8 | 4 | 4 | 4 |
| 9 | 4 | 4 | 4 |
| 10 | 4 | 4 | 4 |
| 11 | 4 | 4 | 4 |
| 12 | 4 | 4 | 4 |
| 13 | 4 | 4 | 4 |
| 14 | 4 | 4 | 4 |

EXAMPLE 3

From each of the copolymers obtained in Referential Example 1–14, a 0.075% aqueous solution was prepared, respectively, with which a dyed cellulosic fiber cloth was treated by the same procedure as in Example 1. The dyes used here were Remazol Black B and Remazol Golden Yellow G manufactured by Hoechst A.G. and Levafix Blue E-3R manufactured by Bayer A.G.

Then, fastnesses to chlorine of the treated dyed cloths were measured by the following two methods:

Method 1: Test piece was dipped in a buffer solution (pH 8.0±0.2) containing 80 ppm of effective chlorine at a liquor ratio of 1:100, after which it was subjected to a washing test at 25° C. for 2 hours according to JIS-L-0821. Then, it was washed with running water for 5 minutes, dewatered and dried.

Method 2: Test piece was put into a domestic washing machine and continuously washed with service water (Tokyo Prefecture) at a water flow rate of 6 liters/minute, at room temperature, for 60 minutes.

The results were as shown in Table 5. As measured by Method 1, an improvement in the fastness to chlorine was observed in the dyed cloths treated according to the invention as compared with the untreated cloth. Although no improvement in the fastness to chlorine was observed as measured by Method 2, no decrease in the fastness to chlorine attributable to the treatment with dye fixative was observed at all.

TABLE 5

| | Fastness to chlorine | | | | | |
|---|---|---|---|---|---|---|
| | Remazol Black B | | Remazol Golden Yellow G | | Levafix Blue E-3R | |
| | Method 1 | Method 2 | Method 1 | Method 2 | Method 1 | Method 2 |
| Untreated | 1 | 3–4 | 1 | 3–4 | 1 | 3 |
| Referential Examples | | | | | | |
| 1 | 4 | 4 | 3 | 4 | 4 | 3 |
| 2 | 4 | 4 | 3 | 4 | 4 | 3 |
| 3 | 4 | 4 | 3 | 4 | 4 | 3 |
| 4 | 5 | 4 | 4 | 4 | 4 | 3 |
| 5 | 4 | 4 | 3 | 4 | 4 | 3 |
| 6 | 4 | 4 | 3 | 4 | 4 | 3 |
| 7 | 4 | 4 | 3 | 4 | 4 | 3 |

TABLE 5-continued

| | Fastness to chlorine | | | | | |
|---|---|---|---|---|---|---|
| | Remazol Black B | | Remazol Golden Yellow G | | Levafix Blue E-3R | |
| | Method 1 | Method 2 | Method 1 | Method 2 | Method 1 | Method 2 |
| 8 | 4 | 4 | 3 | 4 | 4 | 3 |
| 9 | 4 | 4 | 3 | 4 | 4 | 3 |
| 10 | 5 | 4 | 4 | 4 | 4 | 3 |
| 11 | 5 | 4 | 4 | 4 | 4 | 3 |
| 12 | 5 | 4 | 4 | 4 | 4 | 3 |
| 13 | 5 | 4 | 4 | 4 | 4 | 3 |
| 14 | 5 | 4 | 4 | 4 | 4 | 3 |

What is claimed is:

1. A method for improving the color fastness of a dyed cellulosic fiber product which comprises treating a product dyed with a reactive dye with the aqueous solution of a copolymer of monoallylamine and a diallylamine derivative represented by the following formula (I) or (II) or with a salt of said copolymer:

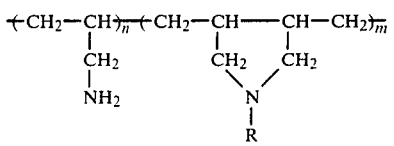

(I)

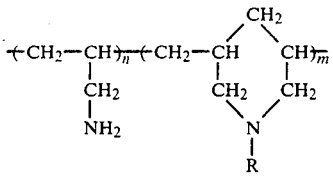

(II)

wherein R represents a group selected from the groups consisting of H, an alkyl group having 1 to 18 carbon atoms, a benzyl group, a group

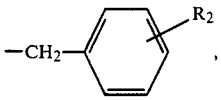

wherein $R_2$ is an alkyl group having 1 to 18 carbon atoms, and a group $-CH_2CH_2OH$; and n and m independently represent a positive integer, provided that the ratio n/m is in the range from 95/5 to 5/95.

2. A method according to claim 1, wherein said copolymer is a copolymer of monoallylamine and diallylamine.

3. A method according to claim 1, wherein said copolymer is a copolymer of monoallylamine and methyldiallylamine.

4. A method according to claim 1, wherein said copolymer is a copolymer of monoallylamine and n-propyldiallylamine.

5. A method according to claim 1, wherein said copolymer is a copolymer of monoallylamine and n-butyldiallylamine.

6. A method according to claim 1, wherein said copolymer is a copolymer of monoallylamine and benzyldiallylamine.

7. A method according to claim 1, wherein said copolymer is a copolymer of monoallylamine and hydroxyethyldiallylamine.

* * * * *